US005601771A

United States Patent [19]

Rüf

[11] Patent Number: 5,601,771

[45] Date of Patent: Feb. 11, 1997

[54] PROCESS FOR THE PRODUCTION OF CELLULOSE FIBRES

[75] Inventor: Hartmut Rüf, Vöcklabruck, Austria

[73] Assignee: Lenzing Aktiengesellschaft, Austria

[21] Appl. No.: 465,320

[22] Filed: Jun. 5, 1995

[30] Foreign Application Priority Data

Sep. 5, 1994 [AT] Austria ..... 1699/94

[51] Int. Cl.[6] ..... D01F 2/02; D01F 11/02; D06M 13/144

[52] U.S. Cl. ..... 264/187; 264/211.14

[58] Field of Search ..... 264/187, 203, 264/211.14, 237

[56] References Cited

U.S. PATENT DOCUMENTS

| | | | |
|---|---|---|---|
| 4,246,221 | 1/1981 | McCorsley, III | 264/203 |
| 4,261,943 | 4/1981 | McCorsley, III | 264/136 |
| 4,416,698 | 11/1983 | McCorsley, III | 106/163.1 |

FOREIGN PATENT DOCUMENTS

| | | | |
|---|---|---|---|
| 356419 | 2/1990 | European Pat. Off. . | |
| 1331914 | 8/1987 | U.S.S.R. | 264/211.14 |
| 92/07124 | 4/1992 | WIPO . | |
| 92/14871 | 9/1992 | WIPO . | |
| 93/19230 | 9/1993 | WIPO . | |

OTHER PUBLICATIONS

Translation of U.S.S.R. 1,331,914 (Published Aug. 23, 1987).

Chanzy et al., Tappi 5th Int'l Dissolving Pulp Conf., pp. 105–108 (1980).

Dube, M., "Precipitation and Crystallization of Cellulose from Amine Oxide Solutions", Tappi International Dissolving and Specialty Pulps Proceedings (1983).

S. Mortimer lecture at Cellucon Conference (1993).

Quenin, I., "Precipitation de la cellulose a partir de solutions dans les oxydes d'amines tertiaires" (1985).

Weigel, P. et al., "Structure formation of cellulosic fibres from aminoxid solvents", Seminar in Stockholm (1994).

*Primary Examiner*—Leo B. Tentoni

*Attorney, Agent, or Firm*—Brumbaugh, Graves, Donohue & Raymond

[57] ABSTRACT

The invention is concerned with a process for the production of cellulose fibres, wherein a solution of cellulose in an aqueous tertiary amine-oxide is extruded into filaments through spinning holes of a spinneret and the extruded filaments are conducted across an air gap into a substantially aqueous precipitation bath, characterized in that the extruded filaments, while being conducted across the air gap, are contacted with an aliphatic alcohol which is present exclusively in gaseous state. The process according to the invention produces cellulose fibres having a very reduced tendency to fibrillation.

11 Claims, No Drawings

PROCESS FOR THE PRODUCTION OF CELLULOSE FIBRES

BACKGROUND OF THE INVENTION

The present invention is concerned with a process for the production of cellulose fibres by extruding a solution of cellulose in a substantially aqueous tertiary amine-oxide through spinning holes of a spinneret into filaments and conducting the extruded filaments across an air gap into a precipitation bath.

As an alternative to the viscose process, in recent years there has been described a number of processes in which cellulose, without derivatization, is dissolved in an organic solvent, a combination of an organic solvent and an inorganic salt, or in aqueous salt solutions. Cellulose fibres made from such solutions have received by BISFA (The International Bureau for the Standardisation of man made Fibres) the generic name Lyocell. As Lyocell, BISFA defines a cellulose fibre obtained by a spinning process from an organic solvent. By "organic solvent", BISFA understands a mixture of an organic chemical and water. "Solvent-spinning" is considered to mean dissolving and spinning without derivatization. So far, however, only one process for the production of a cellulose fibre of the Lyocell type has achieved industrial-scale realization. In this process, N-methylmorpholine-N-oxide (NMMO) is used as a solvent. Such a process is described for instance in U.S. Pat. No. 4,246,221 and provides fibres which present high tensile strength, high wet-modulus and high loop strength. A process for the industrial-scale production of spinnable solutions of cellulose in tertiary amine-oxides is known from EP-A - 0 356 419.

However, the usefulness of plane fibre assemblies, for example fabrics, made from the fibres mentioned above, is significantly restricted by the pronounced tendency of the fibres to fibrillate when wet. Fibrillation means the breaking up of the fibre in longitudinal direction at mechanical stress in a wet condition, so that the fibre gets hairy, furry. A fabric made from these fibres and dyed significantly loses colour intensity as it is washed several times. Additionally, light stripes are formed at abrasion and crease edges. The reason for fibrillation may be that the fibres consist of fibrils which are arranged in the longitudinal direction of the fibre axis and that there is only little crosslinking between these.

WO 92/14871 describes a process for the production of a fibre having a reduced tendency to fibrillation. The reduced tendency to fibrillation is attained by providing all the baths with which the fibre is contacted before the first drying with a maximum pH value of 8.5.

WO 92/07124 also describes a process for the production of a fibre having a reduced tendency to fibrillation, according to which the never dried fibre is treated with a cationic polymer. As such a polymer, a polymer with imidazole and azetidine groups is mentioned. Additionally, there may be carried out a treatment with an emulsifiable polymer, such as polyethylene or polyvinylacetate, or a crosslinking with glyoxal.

In a lecture given by S. Mortimer at the CELLUCON conference held in 1993 in Lund, Sweden, it was mentioned that the tendency to fibrillation increases as drawing is increased.

It has been shown that the known cellulose fibres of the Lyocell type still leave something to be desired in terms of tendency to fibrillation, and thus it is the object of the present invention to provide a cellulose fibre of the Lyocell type having a further reduced tendency to fibrillation.

SUMMARY OF THE INVENTION

This objective is attained in a process of the type described above by contacting the extruded filaments, while conducting them across the air gap, with an aliphatic alcohol which is present exclusively in a gaseous state. The term "air gap" means the gas space extending between the spinneret and the precipitation bath. The gas in this gas space does not necessarily have to be air, it may be any gas or mixture of gases which does not interfere with the spinning process. Thus the term "air gap" includes besides air any such gas or mixture of gases.

As mentioned above, the aliphatic alcohol must be present in "gaseous state". This term is to be understood, for the purpose of the present specification and claims, that the alcohol in the air gap must not be present as a mist. It has been shown that it is important for the process according to the invention not to fall below the dew point of the alcohol used in the air gap. Thus one can be sure to avoid that the alcohol is present in the state of mist-forming droplets. In contrast to the process according to the invention, it is known from U.S. Pat. No. 4,261,943 to conduct the extruded filaments through a mist chamber in which a non-solvent, such as water, is present in the form of very small droplets. By this measure it is intended to reduce the stickiness of the fresh extruded filaments, since the water droplets coagulate the filaments on the surface. In the process according to the invention however, a coagulation on the surface is neither attained nor intended, since this is disadvantageous for the fibres. The present invention is based on the finding that cellulose fibres of the Lyocell type have a significantly reduced tendency to fibrillation when the fresh extruded filaments are exposed to an aliphatic alcohol.

It has been shown that the following alcohols are especially appropiate for reducing the tendency to fibrillation: methanol, ethanol, n-propanol, i-propanol, n-butanol, sec. butanol and tert. butanol. A mixtures of these alcohols may also be used. In "Structure formation of cellulosic fibres from aminoxide solvents" (Weigel P.; Gensrich, J.; Fink, H. P.; Challenges in Cellulosic Man-Made Fibres, Viscose Chemistry Seminar, Stockholm 1994) it is mentioned that by using isopropanol as the precipitation bath the production of a fibre having a reduced tendency to fibrillation is possible. Isopropanol as a precipitating agent however is disadvantageous, since the textile parameters are significantly reduced. The crystallisation of the fibre when using methanol in the spinning bath was examined by Dube, M.;. Blackwell, R. H.: 1983 TAPPI International Dissolving and Specialty Pulps, Proceedings p. 111–119and by Quenin, I.: "Precipitation de la cellulose a partir de solutions dans les oxydes d'amines tertiaires—application au filage", thesis 1985. The present inventors however have found that even when using an aqueous precipitation bath it is possible to produce a fibre having the desired reduced tendency to fibrillation, if in the air gap an aliphatic alcohol in gaseous state is provided.

BRIEF DESCRIPTION OF THE PREFERRED EMBODIMENTS

For an efficient production of fibres having a reduced tendency to fibrillation it has proven advantageous to expose the extruded filaments in the air gap to a gas stream containing the aliphatic alcohol in a gaseous state. The preparation of a gas stream containing alcohol is known to those skilled in the art and may for instance be carried out by simply spraying the alcohol into the gas stream, e.g. by means of an ultrasonic sprayer, or by conducting the gas stream through the alcohol.

Another advantageous embodiment of the process according to the invention consists in extruding the solution of cellulose in an aqueous tertiary amine-oxide through spinning holes of a spinneret arranged in a ring-shape into filaments in such a way that a filament curtain arranged in a ring-shape is conducted across the air gap and the gas stream is conducted from the centre of the ring formed by the filament curtain, the filament curtain being radially exposed to the gas stream from the inside towards the outside. An appropiate device which may be used for exposing the ring-shaped filament curtain to a gas stream in the way described is known from WO 93/19230.

It has proven convenient to expose the extruded filaments additionally to a second gas stream, the filament curtain arranged in a ring-shape being radially exposed to a gas stream from the outside towards the inside. This process of exposure to a gas stream is in principle also known from WO 93/19230.

It has been shown that large air gap lengths have a positive effect on the fibrillation behaviour, while with the small hole/hole distances used in staple fibre spinnerets they rather soon lead to spinning defects. An air gap length of less than 60 mm and more than 20 mm is preferred.

The spinning holes preferably have a diameter of from 80 to 100 μm.

Most preferably, between 0.025 and 0.05 g of cellulose solution per minute are extruded at each spinning hole.

The temperature in the air gap is chosen on the one hand so as not to fall below the dew point, i.e. so that no alcohol condenses in the air gap, and on the other hand so as not to cause spinning problems due to a too high temperature. Values of from 10°to 60° C. may be adjusted, temperatures of from 20 to 40° C. being preferred.

According to the process according to the invention, all known cellulose dopes can be processed. Thus, these dopes may contain of from 5 to 25% of cellulose. However, cellulose contents of from 10 to 18% are preferred. As a raw material for the pulp production, hard or soft wood can be used, and the polymerisation degrees of the pulp(s) may be in the range of the commercial products commonly used in this technique. Mixtures of several pulps may also be used (Chanzy et al., TAPPI 5th International Dissolving Pulp Conference, 1980, p. 105–108). It has been shown however, that in case of a higher molecular weight of the pulp, the spinning behaviour will be better. The spinning temperature may range, depending on the polymerisation degree of the pulp and the solution concentration of from 75°to 140°, and may be optimized in a simple way for any pulp and any concentration. The draw ratio in the air gap depends, when the titer of the fibres is set, on the spinning hole diameter and on the cellulose concentration of the solution. In the range of the preferred cellulose concentration however, no influence of the former on the fibrillation behaviour could be observed while operating in the range of the optimum spinning temperature.

Subsequently, the testing procedures and preferred embodiments of the invention are described in more detail.

Evaluation of fibrillation

The abrasion of the fibres among each other during washing or finishing processes in wet condition was simulated by the following test: 8 fibres were put into a 20 ml sample bottle with 4 ml of water and shaken during 9 hours in a laboratory mechanical shaker of the RO-10 type of the company Gerhardt, Bonn (Germany), at stage 12. Afterwards, the fibrillation behaviour of the fibres was evaluated by microscope, by means of counting the number of fibrils per 0.276 mm of fibre length.

Textile parameters

The fibre tensile strength and fibre elongation conditioned were tested following the BISFA rule on "Internationally agreed methods for testing viscose, modal, cupro, lyocell, acetat and triacetate staple fibres and tows", edition 1993.

EXAMPLES 1–8

A 12% spinning solution of sulfite-pulp and sulfate-pulp (12% water, 76% NMMO) was spun at a temperature of 115° C. As a spinning apparatus, a melt-flow index apparatus commonly employed in plastics processing of the company Davenport was used. This apparatus consists of a heated, temperature-controlled cylinder, into which the dope is filled. By means of a piston, to which a weight is applied, the dope is extruded through the spinneret provided at the bottom of the cylinder. This process is referred to as dry/wet-spinning process, since the extruded filament immerses, once it has passed an air gap, into a precipitation bath.

A total of 9 extrusion tests was carried out, varying the used alcohol, its concentration, the dope throughput and the length of the air gap. As a comparative Example, spinning across an air gap containing no alcohol (80% of relative humidity; 28° C.) was carried out. The column "fibrils" indicates the average number of fibrils on a fibre length of 276 μm. The results are shown in Table 1.

TABLE 1

| Example No. | Alcohol | Alcohol concen-tration | Throughput | Gap | Fibrils |
|---|---|---|---|---|---|
| 1a (C) | — | — | 0.025 | 60 | 8 |
| 1b (C) | — | — | 0.050 | 60 | 16 |
| 2 | methanol | 72 | 0.025 | 60 | 0.4 |
| 3 | methanol | 263 | 0.050 | 60 | 8.5 |
| 4 | ethanol | 240 | 0.025 | 60 | 1.3 |
| 5 | ethanol | 255 | 0.05 | 60 | 3.5 |
| 6 | ethanol | 250 | 0.025 | 30 | 2.3 |
| 7 | i-propanol | 344 | 0.025 | 60 | 4.5 |
| 8 | n-butanol | 247 | 0.025 | 60 | 0.4 |

In the Table, the alcohol used, the alcohol concentration in the air gap (g/m$^3$), the dope throughput (g of dope/hole/minute), the length of the air gap (mm) and the number of fibrils per fibre length of 0.276 μm, which were obtained in the fibrillation test described above, are indicated.

EXAMPLES 9–14

For the Examples 9 to 14, a spinneret having spinning holes arranged in a ring-shape was used in a way that a filament curtain arranged in a ring-shape was conducted across the air gap. For Example 9 (Comparative Example) air and for the Examples 10–14 gas containing methanol was introduced into the center of the circle formed by the spinning holes and radially blown towards the outside. A spinning device by means of which the Examples 9 to 14 may be carried out is known from WO 93/19230 (FIG. 2), the filament curtain arranged in a ring-shape however being exposed to a gas stream only radially from the inside towards the outside. The other conditions were set analogously to those of Examples 1–8.

The results are given in Table 2.

TABLE 2

| Example No. | Alcohol | Alcohol concentration | Throughput | Gap | Fibrils |
|---|---|---|---|---|---|
| 9 (C) | — | — | 0.025 | 60 | >50 |
| 10 | methanol | 60 | 0.025 | 35 | 15.5 |
| 11 | methanol | 60 | 0.025 | 45 | 9.0 |
| 12 | methanol | 60 | 0.025 | 60 | 5.5 |
| 13 | methanol | 110 | 0.025 | 45 | 1.5 |
| 14 | methanol | 140 | 0.025 | 45 | 1.0 |

In Table 3there are shown characteristic fibre parameters for the fibres indicated in Table 2.

TABLE 3

| Example No. | Tensile strength cond. cN/tex | Fibre elongation cond. % | Tensile strength wet cN/tex | Fibre elongation wet % |
|---|---|---|---|---|
| 9 (C) | 28.4 | 14.1 | 24.4 | 26.3 |
| 10 | 29.9 | 17.7 | 27.2 | 25.7 |
| 11 | 28.7 | 17.8 | 26.8 | 28.1 |
| 12 | 27.2 | 17.3 | 25.1 | 24.8 |
| 13 | 26.2 | 19.2 | 22.1 | 24.7 |
| 14 | 29.1 | 16.9 | 23.4 | 23.4 |

The titers (dtex) of the fibres 9, 10, 11, 12, 13 and 14 indicated in Table 3 were 1.71, 1.56, 1.6, 1.62, 2.1 and 1.86 respectively.

I claim:

1. A process for the production of cellulose filaments comprising the steps of extruding a solution of cellulose in an aqueous tertiary amine-oxide through spinning holes of spinneret thereby forming filaments and conducting the extruded filaments across an air gap into a substantially aqueous precipitation bath wherein said extruded filaments, while being conducted across the air gap, are contacted with an aliphatic alcohol, said alcohol being present exclusively in a gaseous state.

2. A process according to claim 1, wherein said alcohol is selected from the group consisting of methanol, ethanol, n-propanol, i-propanol, n-butanol, sec-butanol, tert-butanol, and combinations thereof.

3. A process according to claim 1 or claim 2 wherein said extruded filaments are contacted with said aliphatic alcohol by being exposed in the air gap to a gas stream containing said aliphatic alcohol in a gaseous state.

4. A process according to claim 3 wherein said solution of cellulose in an aqueous tertiary amine-oxide is extruded through spinning holes of a spinneret arranged in a ring-shape thereby forming a filament curtain arranged in a ring-shape which is conducted across the air gap, and wherein said gas stream is introduced in the center of the ring formed by the filament curtain, said filament curtain being exposed to said gas stream which flows radially from the inside of the filament curtain towards the outside of the filament curtain.

5. A process according to claim 4 wherein said extruded filaments additionally are exposed to a second gas stream, said filament curtain arranged in a ring-shape being exposed to said second gas stream which flows radially from the outside of the filament curtain towards the inside of the filament curtain.

6. A process according to claim 1 or claim 2 wherein said air gap has a length of from 20 to 60 mm.

7. A process according to claim 1, wherein said spinning holes have a diameter of from 80 to 100 μm.

8. A process according to claim 7, wherein from 0.025 to 0.05 g of cellulose solution per minute are extruded at each spinning hole.

9. A process according to claim 3 wherein said air gap has a length of from 20 to 60 mm.

10. A process according to claim 5 wherein said air gap has a length of from 20 to 60 mm.

11. A process according to claim 6 wherein said air gap has a length of from 20 to 60 mm.

* * * * *

UNITED STATES PATENT AND TRADEMARK OFFICE

CERTIFICATE OF CORRECTION

PATENT NO. : 5,601,771

DATED : Feb. 11, 1997

INVENTOR(S) : Harmut Ruf

It is certified that error appears in the above-indentified patent and that said Letters Patent is hereby corrected as shown below:

Col. 2, line 40, "mixtures" should read --mixture--

Col. 2, line 41, "In "Structure ..." should start a new paragraph

Col. 2, line 52, "119and" should read --119, and--

Col. 3, line 41, "contain of" should read --contain--

Col. 4, line 10,"acetat" should read --acetate--

Col. 5, line 13, "3there" should read --3, there--.

Signed and Sealed this

Eighth Day of July, 1997

Bruce Lehman

*Attest:*

BRUCE LEHMAN

*Attesting Officer*

*Commissioner of Patents and Trademarks*